US006866480B2

(12) United States Patent
Canali et al.

(10) Patent No.: US 6,866,480 B2
(45) Date of Patent: Mar. 15, 2005

(54) CENTRIFUGAL FAN

(75) Inventors: Umberto Canali, Milan (IT); Dario Brivio, Robbiate (IT)

(73) Assignee: Nicotra S.p.A., Milan (IT)

( * ) Notice: Subject to any disclaimer, the term of this patent is extended or adjusted under 35 U.S.C. 154(b) by 0 days.

(21) Appl. No.: 10/343,461

(22) PCT Filed: Jul. 20, 2001

(86) PCT No.: PCT/IT01/00389

§ 371 (c)(1),
(2), (4) Date: Jan. 31, 2003

(87) PCT Pub. No.: WO02/12729

PCT Pub. Date: Feb. 14, 2002

(65) Prior Publication Data

US 2003/0147745 A1 Aug. 7, 2003

(30) Foreign Application Priority Data

Aug. 3, 2000 (IT) ..... MI20000466 U

(51) Int. Cl.[7] ..... F04D 29/44

(52) U.S. Cl. ..... 415/212.1; 416/214 R; 416/189

(58) Field of Search ..... 416/186 R, 187, 416/189, 214 R, 214 A; 415/211.2, 212.1, 119

(56) References Cited

U.S. PATENT DOCUMENTS 2,727,680 A 12/1955 Madison et al.
4,647,271 A * 3/1987 Nagai et al. ..... 416/186 R

FOREIGN PATENT DOCUMENTS

| | | |
|---|---|---|
| DE | 1403083 | 1/1969 |
| EP | 0692637 | 1/1996 |
| EP | 0867619 | 9/1998 |
| EP | 0955468 | 11/1999 |
| FR | 1141406 | 9/1957 |

* cited by examiner

*Primary Examiner*—F. Daniel Lopez
*Assistant Examiner*—Dwayne J White
(74) *Attorney, Agent, or Firm*—Wenderoth, Lind & Ponack, L.L.P.

(57) ABSTRACT

A centrifugal fan with single or double intake is provided with a fan impeller of a closed type which is formed of a rotating bladed wheel having at least a covering element. Blades of the fan impeller are flat and are backwardly inclined with respect to a direction of rotation of the fan impeller, and the covering element comprises along a direction of flow a frustoconical surface portion, a first curved surface portion and a second curved surface portion, wherein a radius of curvature of the first curved surface portion is smaller than a radius of curvature of the second curved surface portion.

20 Claims, 5 Drawing Sheets

CENTRIFUGAL FAN

This application is a National Stage of PCT/IT01/00389 filed Jul. 20, 2001.

This invention generally relates to a ventilation apparatus particularly, an improved centrifugal fan.

TECHNICAL FIELD

As known, centrifugal fans generally comprise the following essential elements: a casing with a spirally shaped duct, i.e. a so called volute, which is provided with an outlet at its end; an inlet or eye at a center of volute; a fan impeller arranged downstream of the eye and connected to a hub which is keyed on a driving shaft; and a baffle or a diffuser arranged downstream of the fan impeller.

BACKGROUND ART

In centrifugal fans, air or other process gaseous fluid, is drawn in by a fan impeller through an inlet, parallel to a rotational axis, and is delivered by the fan impeller in a direction perpendicular to the rotational axis. This air stream delivered by the fan impeller is diverted by a baffle or further processed by a diffuser before entering a volute which collects and directs the air stream towards an outlet. Centrifugal fans can be of a type with single or double intake, i.e. they can draw in air from one side only of the fan impeller or from two opposite sides thereof.

The fan impeller is formed of a bladed rotating wheel consisting of a disk to which blades are secured at their base. In a case of a fan with single intake the blades are arranged only on one side of the disk, whereas in the case of a fan with double intake the blades are arranged on both sides of the disk.

The blades can be arranged in a radial direction or they can be forwardly or backwardly inclined with respect to a rotational direction of the fan impeller. The blades often have a streamlined profile, but in the prior art flat blades, i.e. non-streamlined blades are also known.

Impellers of centrifugal fans can be of a closed or open type according to whether or not a covering element, a so called impeller covering, consisting of a circular frame fastened to a tip of the blades is provided. Fan impellers provided with inclined blades are generally of the closed type in order to increase a bending strength of the blades.

Several approaches have been adopted in the design of centrifugal fans in order to improve their operational characteristics and efficiency. These approaches consist of for, example, providing the inlet and the outlet with well jointed convergent and divergent ducts, respectively and, downstream of the fan impeller, a diffuser formed of fixed blades suitably shaped and directed for guiding an air stream exiting the fan impeller so as to reduce flow losses. For similar purposes, fan impellers are provided with a great number of blades and these sometimes have a curved guide portion at their leading edge.

SUMMARY OF THE INVENTION

An object of the present invention is to improve efficiency of centrifugal fans by employing an optimal combination of parameters such as a number, shape and arrangement of blades of a fan impeller and a shape of its covering element.

More particularly, this object is attained by providing a centrifugal fan with single or double intake having an impeller of a closed type formed of a rotating bladed wheel provided with at least a covering element, characterized in that blades of the impeller are flat and are backwardly inclined with respect to a rotational direction of the impeller, and in that the covering element comprises along a flow direction a frustoconical surface portion, a first curved surface portion and a second curved surface portion, wherein a radius of curvature of the first curved surface portion is smaller than a radius of curvature of the second curved surface portion.

BRIEF DESCRIPTION OF DRAWINGS

The present invention will be now described in more detail with reference to the accompanying drawings, wherein.

DETAILED DESCRIPTION OF THE PREFERRED EMBODIMENTS

Figure 1:
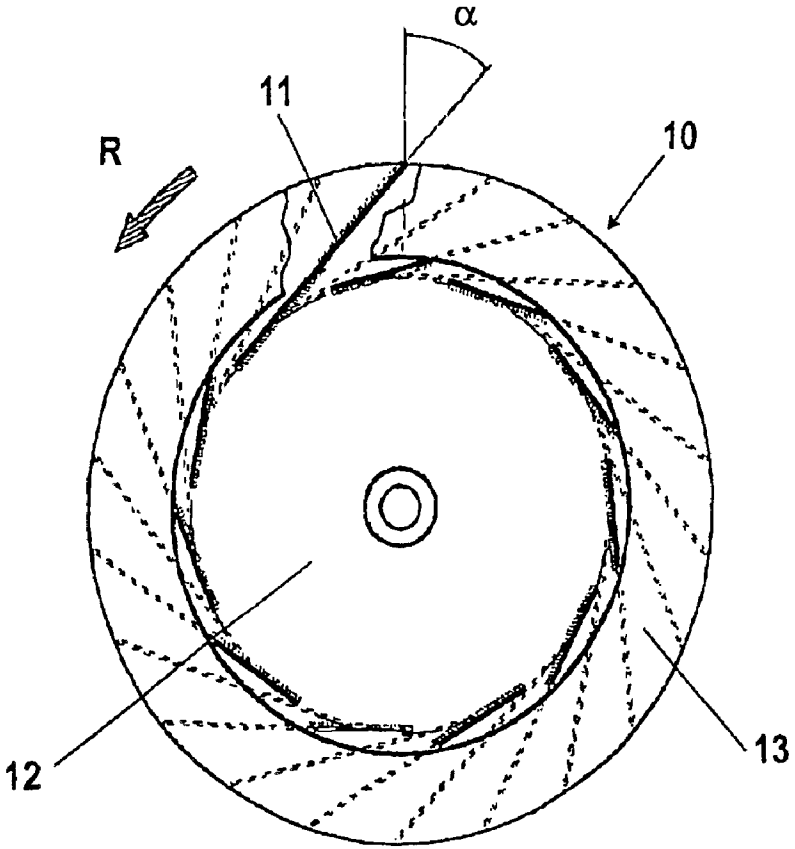
FIG. 1 is a front elevational view of a centrifugal fan impeller of the invention.

Referring to FIG. 1 of the drawings, there is shown an impeller according to the present invention, generally designated by 10. The impeller is adapted to be used in connection with a centrifugal fan with single or double intake and is formed of a closed type rotating bladed wheel.

In the case of a centrifugal fan with single intake, the impeller 10 draws in air or other process gaseous fluid from one side only and comprises therefore a single row of blades connected on one side to a disk 12, and on another side to a ring 13 serving as a covering element.

Instead, in a case of a centrifugal fan with double intake, the impeller 10 draws in air from opposite sides and comprises therefore a pair of blade rows 1, one on each side of the impeller. The blades of each row are connected on one side to disk 12 and on another side to a covering ring 13.

In both of the above cases the impeller disc 12 is provided with a flanged hub for connection to a drive shaft.

Figure 4:
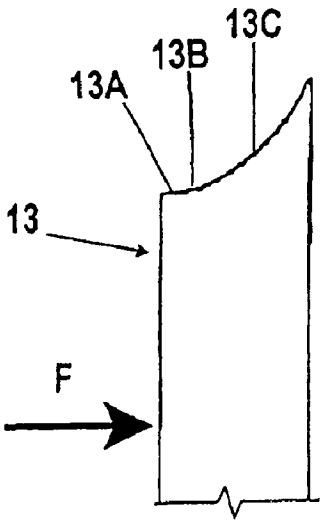
FIG. 4 is a partial side view of a covering element of the impeller of FIG. 1.

The covering ring 13 of the impeller is made of sheet steel and, as shown in FIG. 4, it comprises along a direction of air flow represented in the drawing by arrow F a frustoconical surface portion 13A, a first curved surface portion 13B and a second curved surface portion 13C. According to the invention, a radius of curvature of the first curved surface portion 13B is smaller than a radius of curvature of the second curved surface portion 13C.

The impeller blades are made of sheet steel and are welded at their base and tip to the disc 12 and the covering ring 13, respectively. In number the blades may range from nine to thirteen, and are preferably eleven.

Figure 2:
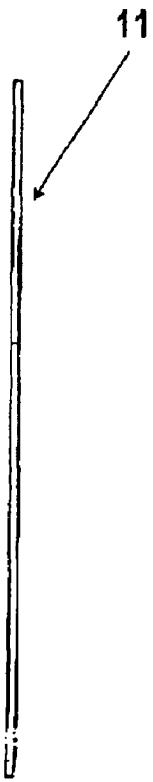
FIGS. 2 and 3 are a front elevational view and a side elevational view, respectively, of a blade of the impeller of FIG. 1.
Figure 3:
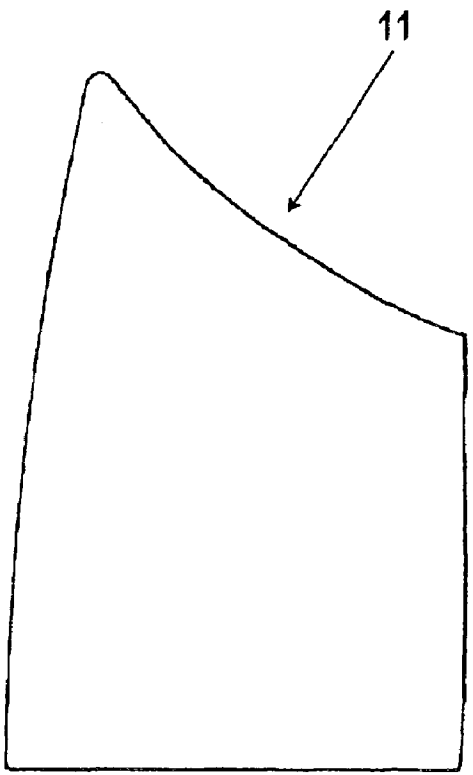

As shown in FIGS. 1–3, the impeller blades are flat, i.e. their profile is not streamlined, and they are backwardly inclined with respect to a direction of rotation, thereby forming an angle a with a radial direction which ranges from 40 to 45 degrees, and is preferably equal to 42.88 degrees.

Figure 6:
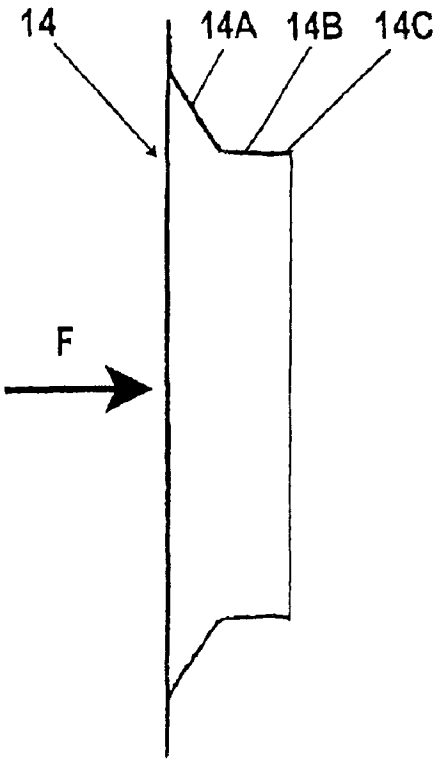
FIGS. 5 and 6 are a front elevational view and a side elevational view respectively, of an inlet arranged upstream the impeller of FIG. 1.
Figure 5:
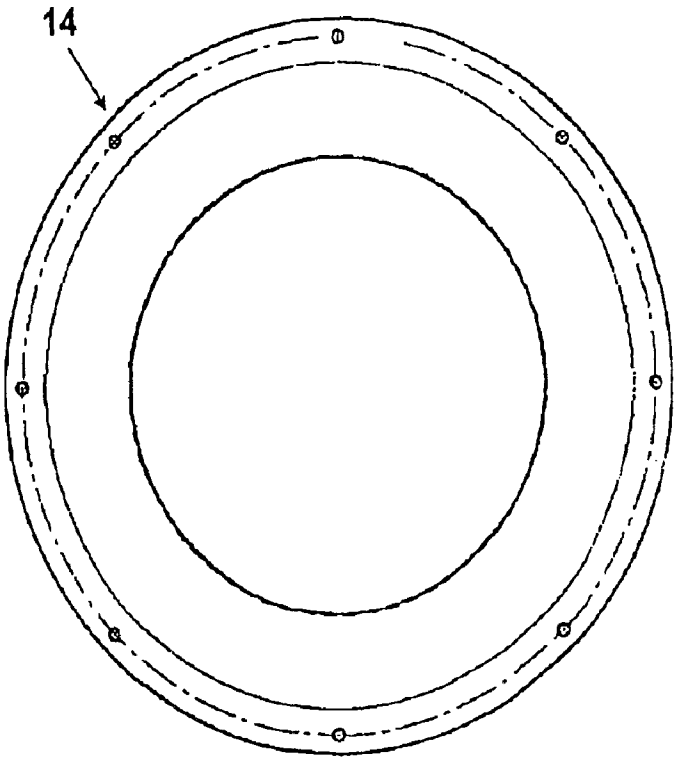

As mentioned above, the impeller 10 is adapted for use in connection with a centrifugal fan. Such fans comprise, in a manner known per se, a volute for collecting an air stream delivered by the impeller and directing it towards an outlet. The centrifugal fan is furthermore provided with an inlet as shown in FIGS. 5 and 6 of the drawings. The inlet is formed of an annular flange 14 made of sheet steel or machined and arranged at a center of the volute. The flange 14 comprises in the direction of air flow represented in the drawing by arrow F a converging surface portion 14A, a substantially cylindrical surface portion 14B and a diverging surface portion 14C which are well jointed together.

Figure 8:
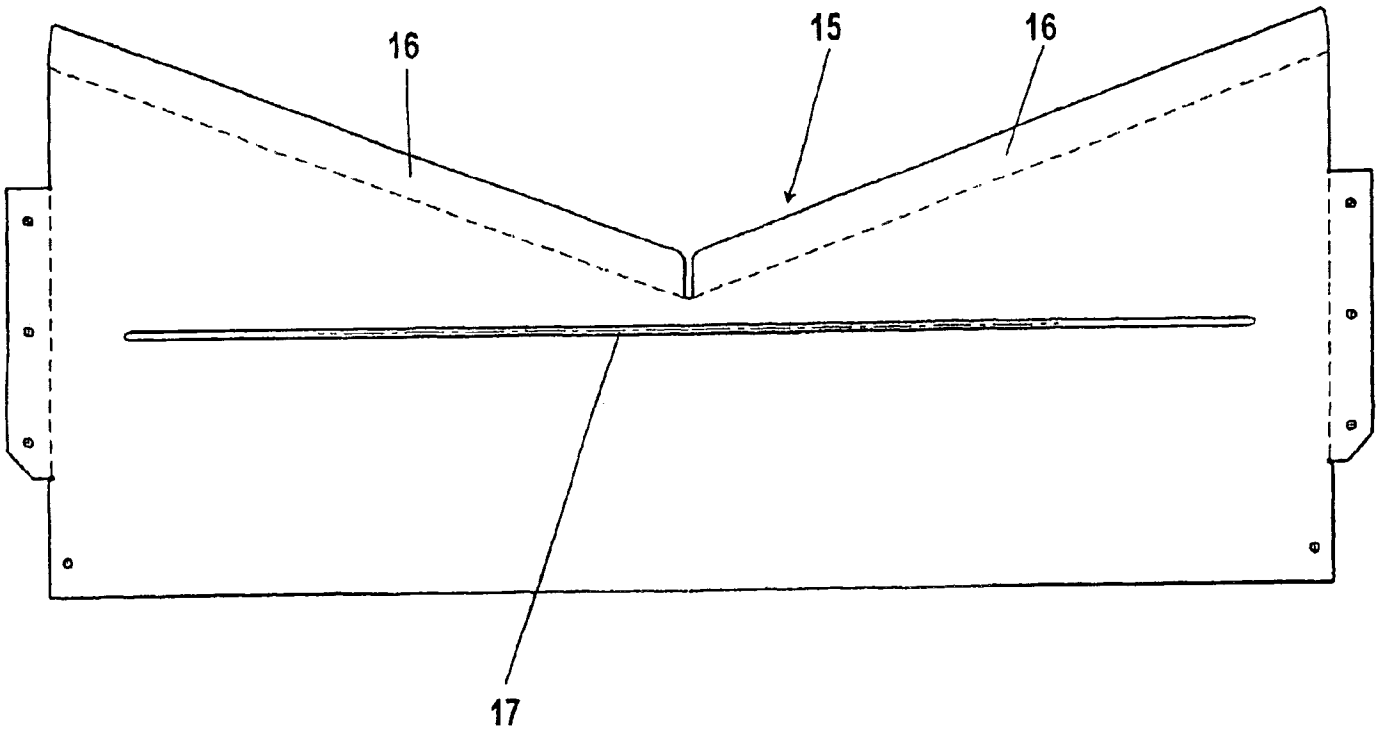
FIGS. 7 and 8 are a front elevational view and a side elevational view, respectively, of a baffle arranged downstream of the impeller of FIG. 1.
Figure 7:
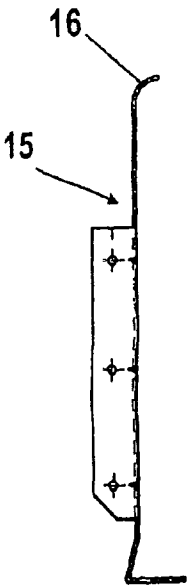
Figure 10:
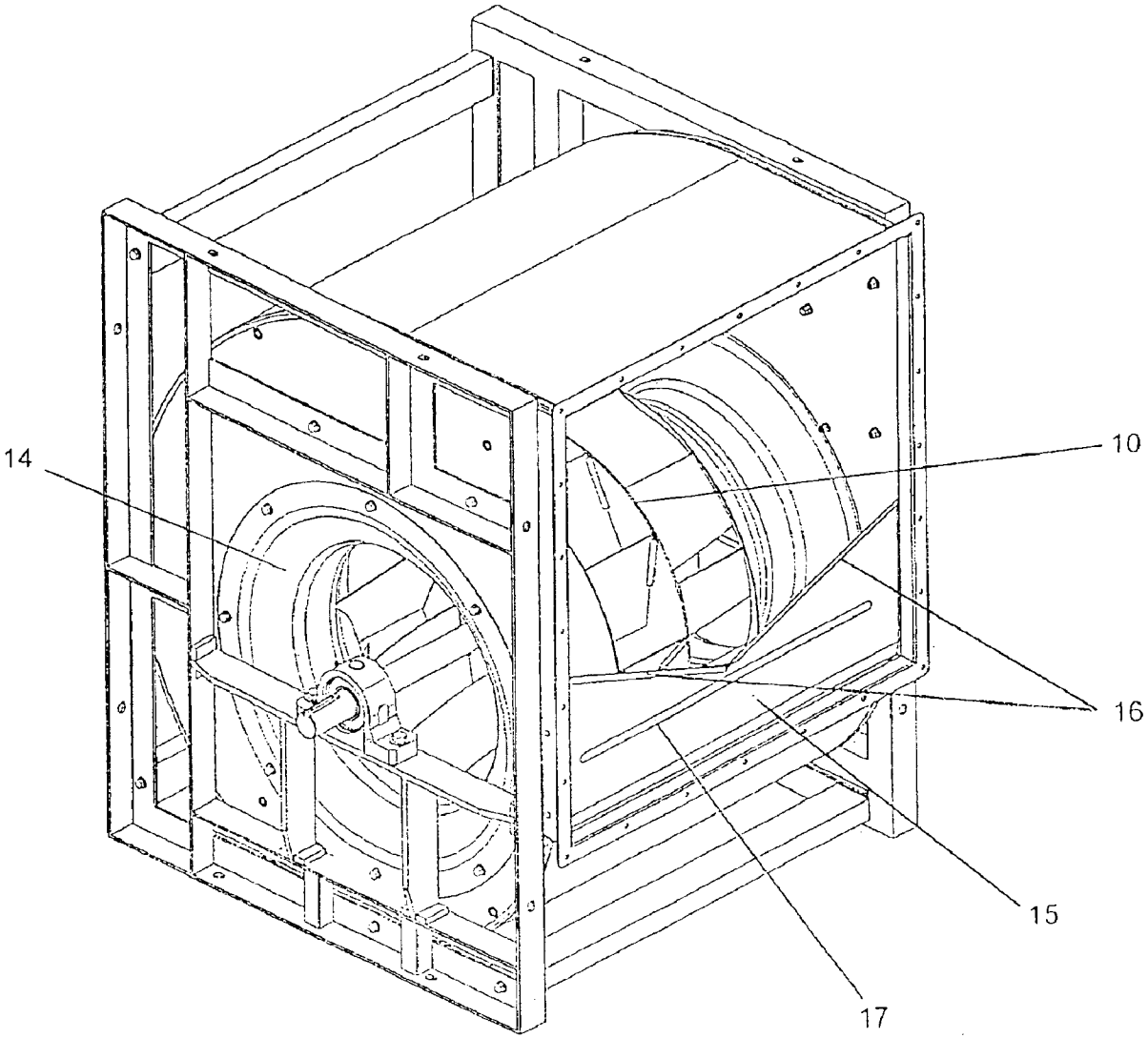
FIG. 10 is a perspective view of a centrifugal fan including the impeller of FIG. 1 and the baffle of FIGS. 7 and 8.

The fan further comprises a baffle 15 shown in FIGS. 7, 8 and 10 of the drawings. The baffle is made of sheet steel and is arranged parallel to a plane of the outlet, which in this case has a square shape. The baffle is defined in its upper portion by two surface portions 16 which are curved along the direction of air flow and have an inclination of 70 degrees with respect to a longitudinal central plane of the fan, thereby generating a V-shaped baffle which improves aerodynamic interference with a pulsating air stream at a periphery of the impeller. Preferably, a height of the baffle, at highest points on its sides, is equal to 38% of a length of a side of the square shaped outlet. The baffle is also provided with a stiffening rib 17 arranged substantially parallel to its base.

Figure 9:
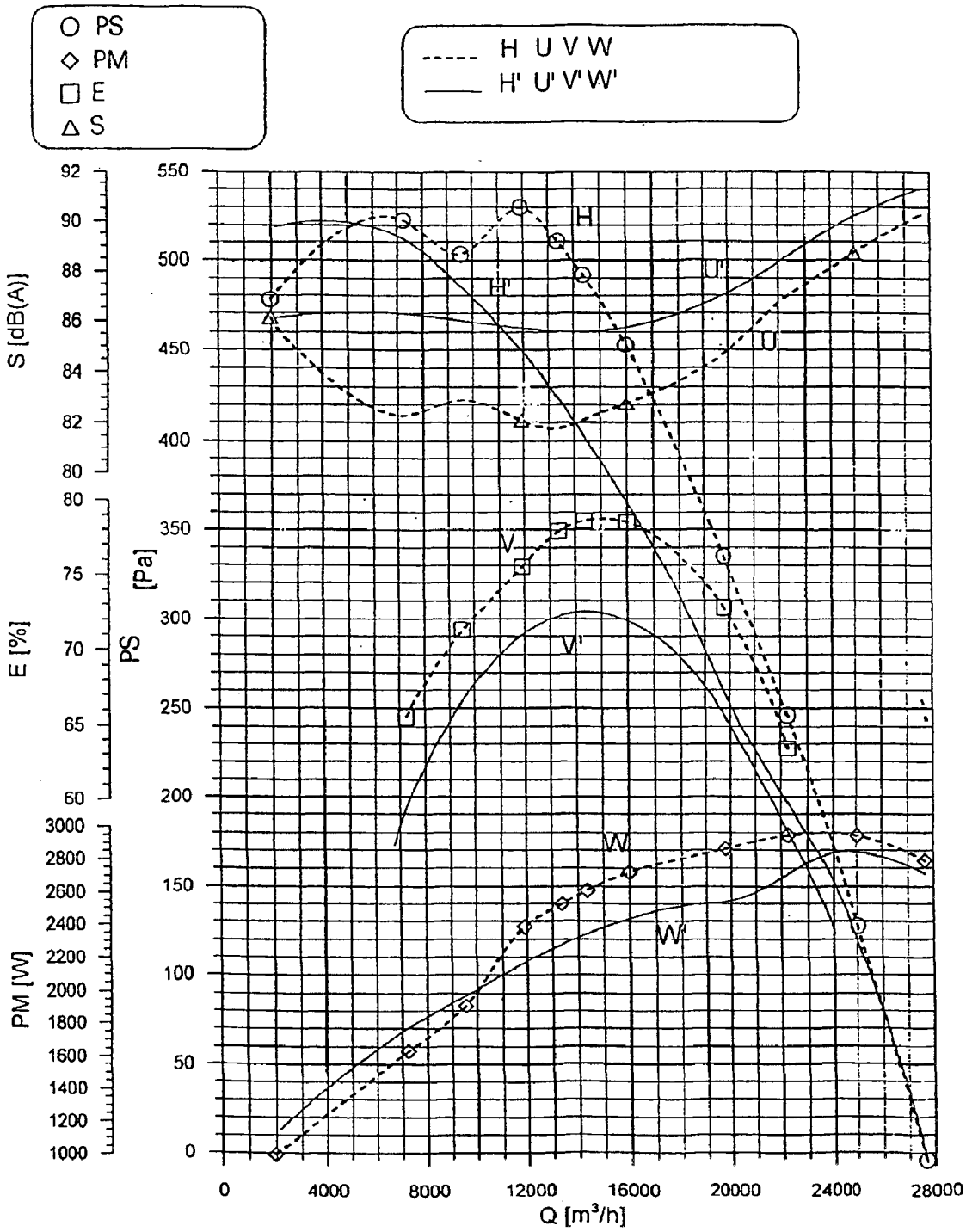
FIG. 9 is a diagram illustrating performance curves of the fan of the invention.

Tests performed on a fan having the above features have shown this fan to have an increase in efficiency and a reduction of its noise level. Results of these tests are shown in FIG. 9. The test refer to two fans, the first according to the teachings of the present invention and the second of a type known in the art. Impellers of the fans had a nominal diameter of 900 mm a nominal speed of 500 rpm and air had a nominal density of 1.20 kg/$M^3$. In FIG. 9 on the measured in $m^3$/h, and on the ordinate axis static pressure PS measured in Pa, are indicated. On the same ordinate axis there are represented mechanical power PM measured in W, fan efficiency E in %, and noise level S in dB. In the diagram curves H, U, V and W represent static pressure, noise level, efficiency and mechanical power, respectively, of the first fan as a function of the rate of flow Q, whereas curves H', U', V' and W' represent static pressure, noise level, efficiency and mechanical power, respectively, of the second fan as a function of the rate of flow Q. By comparing the curves, improvements obtained with the first fan according to the invention are readily apparent.

What is claimed is:

1. A centrifugal fan with a single or double intake, comprising:

a fan impeller of a closed type including blades attached to a rotatable disk and a covering element, wherein (i) said blades are flat and backwardly inclined with respect to a direction of rotation of said fan impeller, and (ii) said covering element includes along a direction of airflow a frustoconical surface portion, a first curved surface portion and a second curved surface portion, with a radius of curvature of said first curved surface portion being smaller than a radius of curvature of said second curved surface portion;

an air inlet located upstream of said fan impeller;

an air outlet located downstream said fan impeller; and a baffle at said air outlet, said baffle comprising a sheet element arranged parallel to a plane of said air outlet and having at a top portion thereof two upwardly diverging surface portions curved in the direction of airflow so as to impart to said top portion substantially a V-shape.

2. The centrifugal fan according to claim 1, wherein said air inlet includes a flange having along the direction of airflow a converging surface portion, a cylindrical surface portion and a diverging surface portion.

3. The centrifugal fan according to claim 2, wherein said baffle further comprises bottom and side portions connected to said air outlet.

4. The centrifugal fan according to claim 3, wherein an angle of inclination of said blades with respect to a radius of said fan impeller ranges from 40 to 45 degrees.

5. The centrifugal fan according to claim 4, wherein dimensions of the centrifugal fan vary with a homothetic relationship according to a size of the centrifugal fan.

6. The centrifugal fan according to claim 3, wherein said blades range from nine to thirteen in number.

7. The centrifugal fan according to claim 6, wherein dimensions of the centrifugal fan vary with a homothetic relationship according to a size of the centrifugal fan.

8. The centrifugal fan according to claim 3, wherein an angle between said two upwardly diverging surface portions of is equal to 140 degrees.

9. The centrifugal fan according to claim 8, wherein dimensions of the centrifugal fan vary with a homothetic relationship according to a size of the centrifugal fan.

10. The centrifugal fan according to claim 3, wherein said air outlet is square in shape, and a height of said side portions connected to said air outlet is equal to 38% of a length of a side of said air outlet.

11. The centrifugal fan according to claim 10, wherein dimensions of the centrifugal fan vary with a homothetic relationship according to a size of the centrifugal fan.

12. The centrifugal fan according to claim 3, wherein said converging surface portion has an angle of inclination that ranges from 27 to 35 degrees with respect to a plane orthogonal to the air flow direction according to a size of the centrifugal fan.

13. The centrifugal fan according to claim 12, wherein dimensions of the centrifugal fan vary with a homothetic relationship according to a size of the centrifugal fan.

14. The centrifugal fan according to claim 3, wherein dimensions of the centrifugal fan vary with a homothetic relationship according to a size of the centrifugal fan.

15. The centrifugal fan according to claim 1, wherein an angle of inclination of said blades with respect to a radius of said fan impeller ranges from 40 to 45 degrees.

16. The centrifugal fan according to claim 1, wherein said blades range from nine to thirteen in number.

17. The centrifugal fan according to claim 1, wherein an angle between said two upwardly diverging surface portions of is equal to 140 degrees.

18. The centrifugal fan according to claim 1, wherein said air outlet is square in shape, and a height of said side portions connected to said air outlet is equal to 38% of a length of a side of said air outlet.

19. The centrifugal fan according to claim 1, wherein said converging surface portion has an angle of inclination that ranges from 27 to 35 degrees with respect to a plane orthogonal to the air flow direction according to a size of the centrifugal fan.

20. The centrifugal fan according to claim 1, wherein dimensions of the centrifugal fan vary with a homothetic relationship according to a size of the centrifugal fan.

* * * * *